US006290465B1

(12) United States Patent
Lammas et al.

(10) Patent No.: US 6,290,465 B1
(45) Date of Patent: Sep. 18, 2001

(54) ROTOR BLADE

(75) Inventors: Andrew J. Lammas, Maineville; Nicholas J. Kray, Blue Ash, both of OH (US)

(73) Assignee: General Electric Company, Cincinnati, OH (US)

( * ) Notice: Subject to any disclaimer, the term of this patent is extended or adjusted under 35 U.S.C. 154(b) by 0 days.

(21) Appl. No.: 09/364,605

(22) Filed: Jul. 30, 1999

(51) Int. Cl.[7] ..... F01D 5/14
(52) U.S. Cl. ..... 416/223 A; 416/238; 416/219 R
(58) Field of Search ..... 415/191, 195; 416/223 R, 238, 223 A, 244 A, 219 R, 204 R, 202

(56) References Cited

U.S. PATENT DOCUMENTS 2,962,260 * 11/1960 Foley ..... 415/191
4,131,387 * 12/1978 Kazin et al. ..... 416/223 A
4,460,315 * 7/1984 Tseng et al. ..... 416/219 R
5,249,922 * 10/1993 Sato et al. ..... 415/191
6,071,077 * 1/2000 Rowlands ..... 416/223 A

* cited by examiner

*Primary Examiner*—F. Daniel Lopez
*Assistant Examiner*—Richard Woo
(74) *Attorney, Agent, or Firm*—Andrew C. Hess; Nathan D. Herkamp

(57) ABSTRACT

A rotor blade for a turbine engine including a blade root section and an airfoil section which extends radially outward along a radial line $R_{AS}$ from the blade root section, is described. The radial line $R_{AS}$ extends at an angle relative to a plane extending across a top surface of the platform, rather than normal, or perpendicular, to such plane. As a result, and during a blade out event, an over turning moment is generated in a root of the airfoil section. The overturning moment facilitates bending the airfoil section reducing damage to the stator.

14 Claims, 4 Drawing Sheets

ROTOR BLADE

BACKGROUND OF THE INVENTION

This invention relates generally to turbine engines, and more specifically, to a blade for a compressor for such engines.

A turbine engine typically includes a fan and a low pressure compressor, sometimes referred to as a booster. The fan includes a rotor having a plurality of blades. The low pressure compressor also includes a rotor having a plurality of rotor blades which extend radially outward across an airflow path. The fan rotor is coupled to the booster rotor. The blades generally include an airfoil section mounted radially outward of a blade root section. The rotor is housed within a stator case.

During engine certification, a test sometimes referred to as a "blade out" test is run. In the blade out test, a fan blade is released at its root, which creates an imbalance in the fan rotor. Since the fan rotor is coupled to the booster rotor, the imbalance in the fan rotor affects operation of the booster rotor. Specifically, the blade tips can rub the case. The radial and tangential loads imposed by the blade tips on the case create stresses in the case, which can lead to unexpected failure of stator case skin or flanges.

To withstand such stresses, the strength of the stator case can be increased. For example, the material used to fabricate the stator case can be selected so as to have sufficient strength to withstand stresses caused by rubbing of the rotor blades. Also, and rather than using other materials, thicker flanges, thicker stator skin, and additional bolts can be added to increase the stator strength. Increasing the stator case strength, however, typically results in increasing the weight and cost of the engine.

BRIEF SUMMARY OF THE INVENTION

Rotor blades and vanes for a turbine engine which are configured to more easily bend, or buckle, than known rotor blades and vanes are described. In an exemplary embodiment, a rotor blade includes a blade root section and an airfoil section configured to more easily bend, or buckle, than known airfoil sections. Providing that the airfoil section more easily bends, or buckles, facilitates reducing the forces on, and damage of, stator components during a blade out event.

In one specific embodiment, the blade airfoil section extends radially outward along a radial line $R_{AS}$ from the blade root section. The radial line $R_{AS}$ extends at an angle relative to a plane extending across a top surface of a platform between the airfoil section and the blade root section, rather than normal, or perpendicular, to such plane. As a result, and during a blade out event, an over turning moment is generated in a root of the airfoil section. The overturning moment facilitates bending the airfoil section.

DETAILED DESCRIPTION OF THE INVENTION

Figure 1:
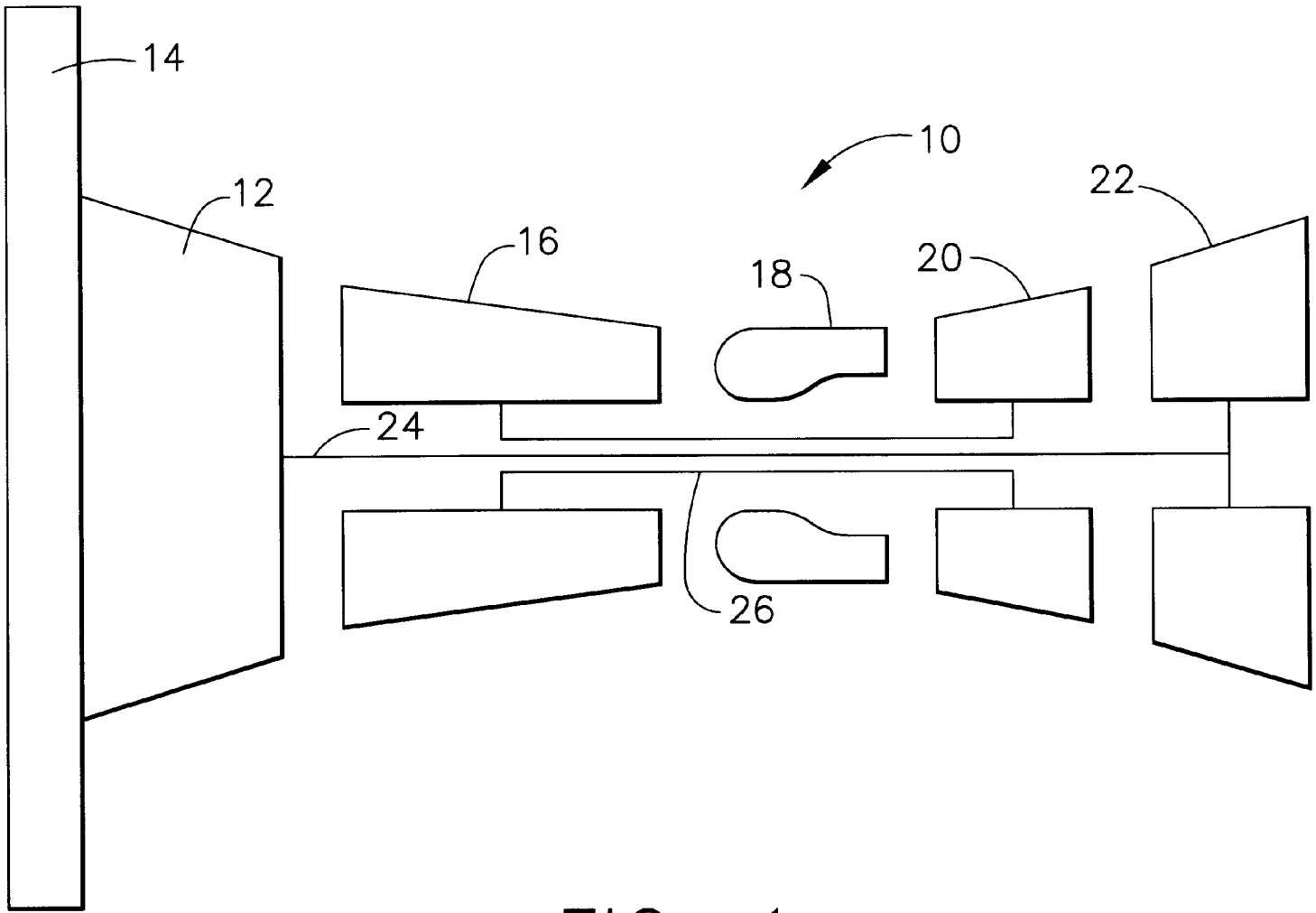
FIG. 1 is a schematic illustration of a turbine engine.

FIG. 1 is a schematic illustration of a turbine engine 10. Engine 10 includes a low pressure compressor 12, sometimes referred to as a booster, and a fan 14 located immediately upstream from booster 12. Engine 10 also includes a high pressure compressor 16, a combustor 18, a high pressure turbine 20 and a low pressure turbine 22. Booster 12 and fan 14 are coupled to low pressure turbine 22 by a first shaft 24. High pressure compressor 16 is coupled to high pressure turbine 20 by a second shaft 26.

Figure 2:
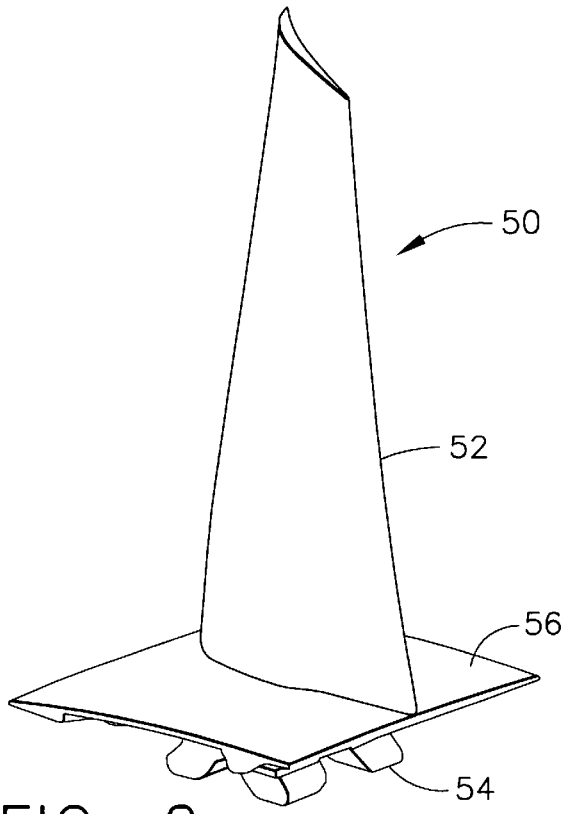
FIG. 2 is a perspective view of a low pressure compressor rotor blade.

A typical compressor rotor assembly of a turbine engine includes a plurality of rotor blades extending radially outward across an airflow path. An example of a known rotor blade 50 for a low pressure compressor is illustrated in FIG. 2. Blade 50 includes an airfoil section 52 extending radially outward from a blade root section 54. A platform 56 is located between airfoil section 52 and blade root section 54, and platform 56 forms a portion of the boundary between the rotor and the working medium. Blade 50 is normally mounted in a rim of a rotor disk with root section 54 interlockingly engaging a slot in the rim. Compressor blade roots are curvilinear in form and referred to as dovetail roots and the matching conforming slots are referred to as dovetail slots.

Figure 3:
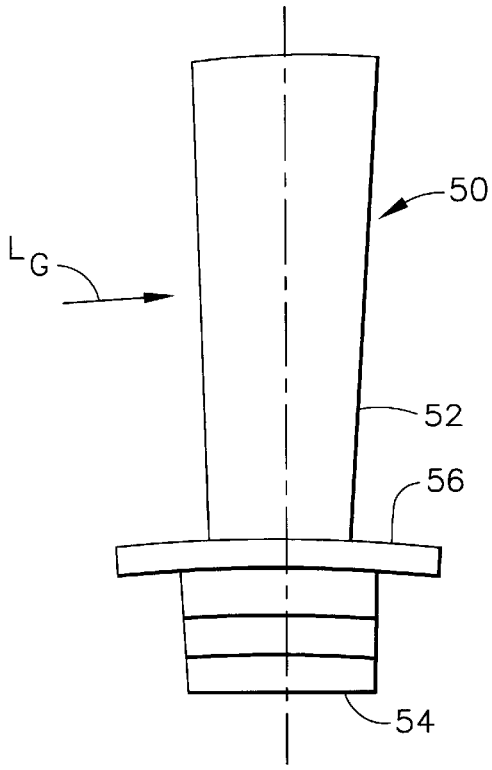
FIG. 3 is a schematic front view of the blade shown in FIG. 2.

As shown in FIG. 3, which is a front view of blade 50, as blade 50 rotates, gas loads Ls act on blade 50. Blade 50 typically is mounted to the rotor disk so that blade 50 is angularly offset, or tilted, so that blade bending created by the gas loads is balanced, or offset, by bending caused by rotation at the airfoil root.

Figure 4:
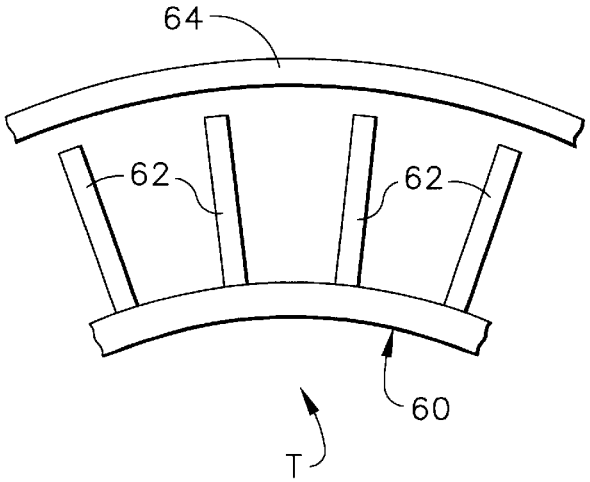
FIG. 4 is a schematic illustration of a plurality of rotor blades with respect to a stator case.
Figure 5:
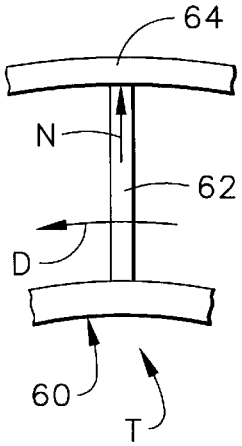
FIG. 5 illustrates blade contact with the stator case.

Referring now to FIGS. 4 and 5, which are schematic illustrations of a motor 60 including a plurality of blades 62 positioned relative to a stator case 64. During a "blade out" event, rotor 60 has a trajectory into case 64, and blades 62 contact case 64. A load N is transmitted into, and supported by, case 64 from each blade 62 in contact with case 64. Arrow D indicates the direction of rotation of rotor 60, and arrow T indicates rotor 60 trajectory into case 64.

Figure 6:
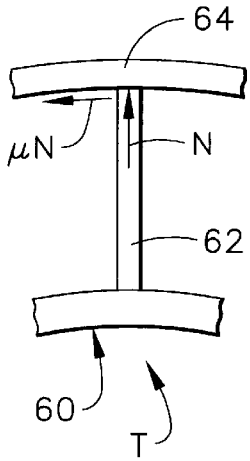
FIG. 6 is illustrates in further detail the forces generated during a blade contact event.
Figure 7:
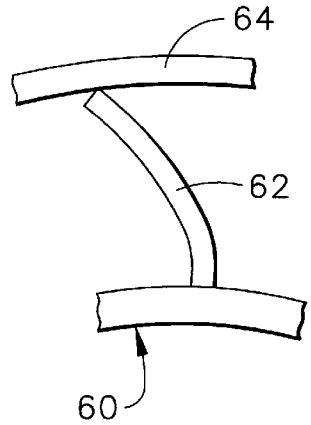
FIG. 7 illustrates (exaggerated) blade response to a blade out event.

As shown in FIG. 6, a friction component $\mu$N destabilizes and facilitates buckling of blade 62. More specifically, forces $\mu$N and N force blade 62 to bend and buckle, which allows additional closure between rotor 60 and stator case 64, as shown in FIG. 7. It is believed that the forces $\mu$N and N generated by the rubbing of blade 62 on case 64 result in damaging case 64.

Figure 8:
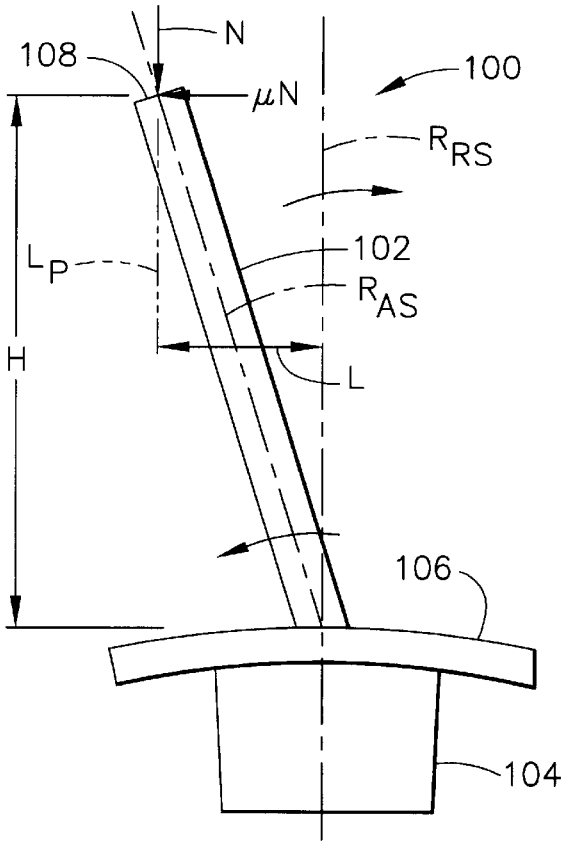
FIG. 8 is a schematic front view of a blade in accordance with one embodiment of the present invention.

FIG. 8 is a schematic front view of a blade 100 in accordance with one embodiment of the present invention.

Blade 100 includes an airfoil section 102 extending radially outward from a blade root section 104. A platform 106 is located between airfoil section 102 and blade root section 104, and platform 106 forms a portion of the boundary between the rotor and the working medium. Blade 100 is normally mounted in a rim of a rotor disk with root section 104 interlockingly engaging a slot in the rim. Compressor blade roots are curvilinear in form and referred to as dovetail roots and the matching conforming slots are referred to as dovetail slots.

Airfoil section 102 extends along a radial line $R_{AS}$ at an angle relative to a plane extending across a top surface of platform 106. In the embodiment of blade 100 illustrated in FIG. 8, radial line $R_{AS}$ is straight. More particularly, blade 100 generates an over turning moment at the root of airfoil section 102 which assists in bending blade airfoil section 102 to reduce the load on the stator, e.g., the stator case, during a blade out event. The moment is equal to:

$$NL+\mu NH$$

where:

L=the length, or distance, from a radial line $R_{RS}$ through root section 104 and a parallel line $L_P$ passing through a center point of a top surface 108 of airfoil section 102, and H=the distance from a top surface of platform 106 and top surface 108 of airfoil section 102.

An exemplary range of values for H are 2 inches to 12 inches, and typically 4 inches to 9 inches. Length L, which is an offset, is selected based on the desired design strength at the root of the blade, and the size of the blade. Blade 100 is fabricated from materials such as titanium and aluminum using well known blade fabrication techniques.

Figure 9:
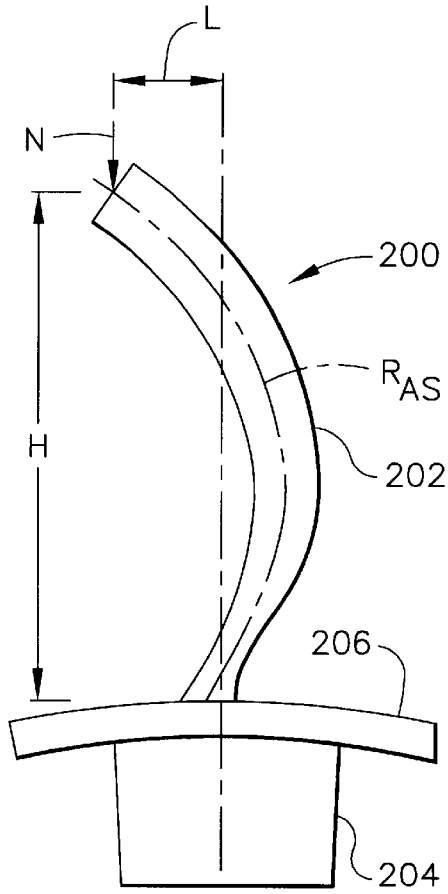
FIG. 9 is a schematic view of a blade in accordance with another embodiment of the present invention.

FIG. 9 is a schematic view of a blade 200 in accordance with another embodiment of the present invention. Blade 200 includes an airfoil section 202 extending radially outward from a blade root section 204. A platform 206 is located between airfoil section 202 and blade root section 204, and platform 206 forms a portion of the boundary between the rotor and the working medium. Blade 200 is normally mounted in a rim of a rotor disk with root section 204 interlockingly engaging a slot in the rim.

Airfoil section 202 is bowed, and extends along radial line $R_{AS}$ at an angle relative to a plane extending across a top surface of platform 206. In the embodiment of blade 200 illustrated in FIG. 9, radial line $R_{AS}$ is curved. By bowing airfoil section 202, the center of gravity of section 202 is located over blade root section 204, which reduces the root section stresses yet airfoil section 202 will still buckle.

In accordance with yet another embodiment of the present invention, the airfoil section (e.g., airfoil section 102, 202) thickness also varies along its length. The airfoil section with a varying thickness can extend along a straight radial line $R_{AS}$ as with blade section 102, or along a curved radial line as with blade section 202.

Figure 10:
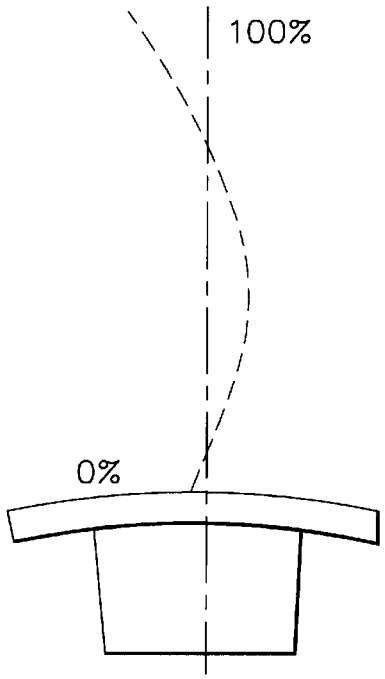
FIG. 10 illustrates reference points along an airfoil section.
Figure 11:
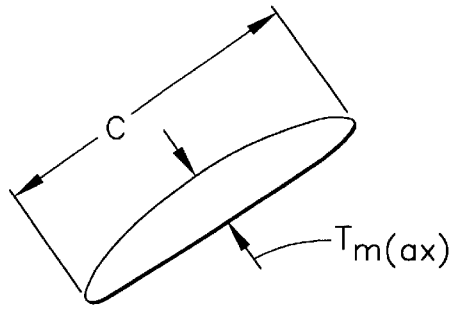
FIG. 11 is a cross sectional view through the airfoil section shown in FIG. 10.
Figure 12:
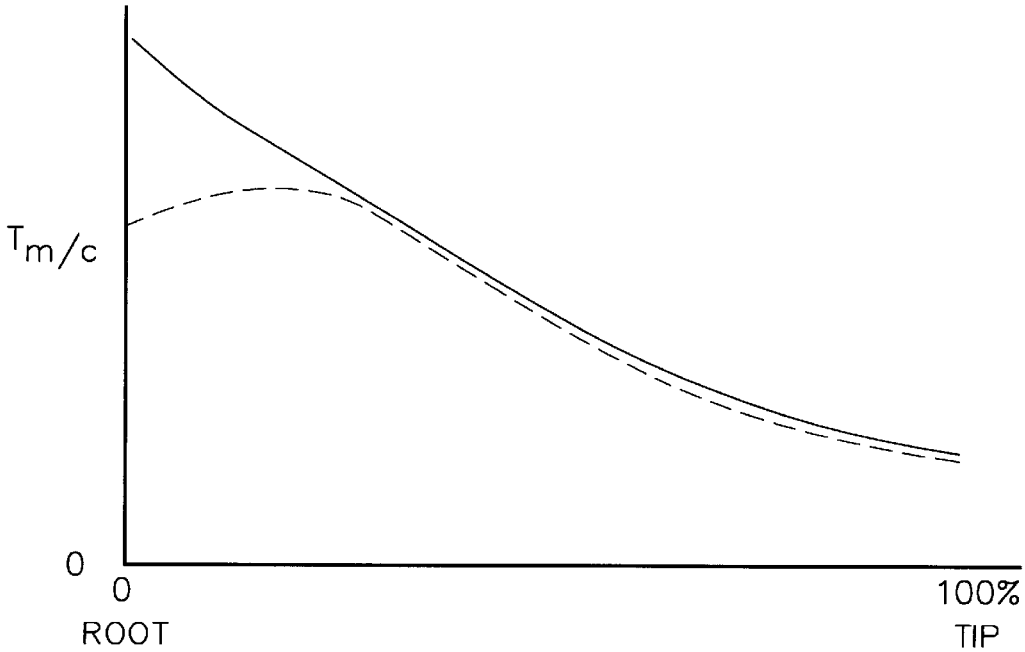
FIG. 12 is a graphical representation comparing the thickness of a known airfoil section and the length, or chord, of the airfoil section.

More specifically, FIG. 10 illustrates reference points, i.e., 0% (the airfoil section root) to 100% (the airfoil section tip) along the airfoil section. FIG. 11 is a cross section of an airfoil section and illustrates the measurements for the airfoil section thickness $T_{M(ax)}$ and distance C. FIG. 12 is a graphical representation comparing the ratio of $T_m/C$(shown as $T_{m(ax)}$ in FIG. 11) over the length of the airfoil section (0% to 100%). The ratios of the varying thickness airfoil section are shown in dashed line and the ratios of known airfoil section are shown in solid line. As shown in FIG. 12, the varying thickness blade is less thick than known blades for a distance from about 0% to 30% of its length.

Figure 13:
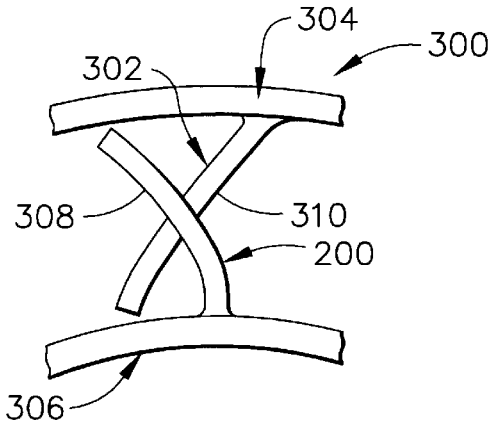
FIG. 13 is a schematic illustration of a blade and vane arrangement in accordance with one embodiment of the present invention.

FIG. 13 is a schematic illustration of a blade and vane arrangement 300 in accordance with one embodiment of the present invention. Arrangement 300 includes blade 200 and a vane 302. Vane 302 has the same curved, or bowed, shape as blade 200, except that vane 302 is secured to stator case 304 rather than to a rotor 306. Vane 302 is arranged so that vane 302 opposes blade 200, i.e., concave surfaces 308 and 310 of blade 200 and vane 302, respectively, face each other. This particular arrangement is believed to also reduce aeromechanic excitation.

While the invention has been described in terms of various specific embodiments, those skilled in the art will recognize that the invention can be practiced with modification within the spirit and scope of the claims.

What is claimed is:

1. A rotor blade for a turbine engine comprising:

a blade root section;

an airfoil section extending radially outward along a radial line $R_{AS}$ from said a blade root section; and a platform between said airfoil section and said blade root section, said radial line $R_{AS}$ extending at an oblique angle with respect to a plane extending across a top surface of said platform.

2. A rotor blade in accordance with claim 1 wherein said radial line $R_{AS}$ is straight.

3. A rotor blade in accordance with claim 1 wherein said radial line $R_{AS}$ is curved.

4. A rotor blade in accordance with claim 1 wherein during a blade out event, an over turning moment is generated in a root of said airfoil section.

5. A rotor blade in accordance with claim 4 wherein said over turning moment is equal to:

$$NL+\mu NH$$

where:

N=force of a blade tip against a stator surface and normal to said stator surface, L=length from a radial line $R_{RS}$ through said root section and a parallel line $L_P$ passing through a center point of a top surface of said airfoil section, $\mu$=a coefficient of friction between said blade tip and said stator surface, and H=a distance from a top surface of said platform and said top surface of said airfoil section.

6. A rotor blade in accordance with claim 1 wherein a thickness of said airfoil section varies along its length.

7. A turbine engine comprising a rotor, said rotor comprising:

a rotor disk, and a blade secured to said rotor disk, said blade comprising a blade root section, an airfoil section extending radially outward along line $R_{AS}$ from said a blade root section, and a platform between said airfoil section and said blade root section, said radial line $R_{AS}$ extending at an angle relative to a plane extending across a top surface of said platform, said blade configured to bend during a blade out event.

8. A turbine engine in accordance with claim 7 wherein said radial line $R_{AS}$ is straight.

9. A turbine engine in accordance with claim 7 wherein said radial line $R_{AS}$ is curved.

10. A turbine engine in accordance with claim 7 wherein during a blade out event, an over turning moment is generated in a root of said airfoil section, said over turning moment equal to:

$$NL+\mu NH$$

where:

N=force of a blade tip against a stator surface and normal to said stator surface, L=length from a radial line $R_{RS}$ through said root section and a parallel line $L_P$ passing through a center point of a top surface of said airfoil section, $\mu$=a coefficient of friction between said blade tip and said stator surface, and H=a distance from a top surface of said platform and said top surface of said airfoil section.

11. A turbine engine in accordance with claim 7 wherein a thickness of said airfoil section varies along its length.

12. A turbine engine in accordance with claim 7 wherein said rotor comprises a component of a low pressure compressor.

13. A turbine engine in accordance with claim 12 wherein said low pressure compressor further comprises at least one vane.

14. A turbine engine in accordance with claim 13 wherein said vane comprises a concave surface, and said blade comprises a concave surface, and said vane concave surface faces said blade concave surface.

* * * * *